US007532734B2

(12) United States Patent
Pham et al.

(10) Patent No.: US 7,532,734 B2
(45) Date of Patent: May 12, 2009

(54) HEADPHONE FOR SPATIAL SOUND REPRODUCTION

(76) Inventors: Hong Cong Tuyên Pham, 21 rue Roger Salengro, F-94460 Valenton (FR); Ambroise Recht, 59 Boulevard Lefebvre, F-75015 Paris (FR)

( * ) Notice: Subject to any disclaimer, the term of this patent is extended or adjusted under 35 U.S.C. 154(b) by 593 days.

(21) Appl. No.: 10/553,012

(22) PCT Filed: Apr. 28, 2004

(86) PCT No.: PCT/FR2004/001033

§ 371 (c)(1),
(2), (4) Date: Oct. 11, 2005

(87) PCT Pub. No.: WO2004/098235

PCT Pub. Date: Nov. 11, 2004

(65) Prior Publication Data

US 2006/0204016 A1 Sep. 14, 2006

(30) Foreign Application Priority Data

Apr. 29, 2003 (FR) ..... 03 05266

(51) Int. Cl.
*H04R 25/00* (2006.01)

(52) U.S. Cl. ..... 381/370; 381/371

(58) Field of Classification Search ..... 381/370, 381/371, 373

See application file for complete search history.

(56) References Cited

U.S. PATENT DOCUMENTS

| | | | | |
|---|---|---|---|---|
| 5,260,920 | A | 11/1993 | Ide et al. | |
| 6,038,330 | A * | 3/2000 | Meucci, Jr. | 381/371 |
| 6,263,085 | B1 * | 7/2001 | Weffer | 381/371 |
| 2003/0103637 | A1 * | 6/2003 | Huang | 381/309 |
| 2007/0032964 | A1 * | 2/2007 | Kaldor et al. | 381/370 |

FOREIGN PATENT DOCUMENTS

| | | |
|---|---|---|
| EP | 0 848 572 A | 6/1998 |
| EP | 1 274 274 A | 1/2003 |
| WO | WO 02/25990 A | 3/2002 |

OTHER PUBLICATIONS

Theile, G.; Wittek, H.; Reisinger, M.; "Wellenfeldsynthese, Teil I" Fernseh- Und Kinotechnik, Vorgetragen Auf Der 22, Tonmeisttagung in Hannover, vol. 57, No. 4/2003, Apr. 1, 2003.

* cited by examiner

*Primary Examiner*—Suhan Ni
*Assistant Examiner*—Jasmine Pritchard
(74) *Attorney, Agent, or Firm*—Egbert Law Offices PLLC

(57) ABSTRACT

The invention concerns a headphone and a compatible recording device for spatial sound reproduction provided with two earphones, each earphone having a support defining at least partly a cap-like surface comprehensively covering the listener's ear. Each earphone includes at least five speakers arranged on said support. The speakers are adapted to reproduce an acoustic field, such that it is perceived as being continuous by the human ear, for acoustic frequencies lower than a given maximum frequency.

6 Claims, 3 Drawing Sheets

HEADPHONE FOR SPATIAL SOUND REPRODUCTION

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention refers to a device, in particular, an acoustic headset, for sound spatialisation. The invention also refers to a recording device which is compatible with such a spatialisation device.

BACKGROUND OF THE INVENTION

By sound spatialisation is meant the restitution of the three-dimensional characteristics—azimuth, elevation and distance—of a sound source emitting a sound of given frequency and intensity.

Numerous systems and devices are known, whereof the purpose is to solve such a technical problem. However, they suggest most often only simple immersion in a sound atmosphere, without restituting truly the three-dimensional characteristics of a sound. These systems may be implemented either in a room, in which case the room is fitted with several baffles equipped with loudspeakers, or using an acoustic headset, each headphone of the headset comprising a loudspeaker.

According to a first method, so-called stereophony over two channels, for simulating the displacement of a sound source, two loudspeakers are used, one channel per loudspeaker, and the sound intensity is weighted on both corresponding channels, while distributing the power to be transmitted among both loudspeakers. It is therefore possible to move the sound source while acting on the weighting coefficient.

However, this technique has the shortcoming of placing the sound sources inside the listener's head. Moreover, the sound sources may only be moved in a single dimension instead of the whole space.

To improve the impression of immersion into a sound atmosphere, it has been suggested to use four or five loudspeakers in a room. It is notably the "Dolby Surround" device. Such a system includes three front acoustic channels and one rear acoustic channel. A central loudspeaker and two left and right loudspeakers broadcast said front channels. The central loudspeaker focuses the sound sources regardless of the listening position.

The fourth channel is broadcast by two rear baffles and corresponds to ambiance information and reverberation effects.

However, such a system does not enable to locate the sound sources precisely since the central loudspeaker focuses them regardless of the listening position. Moreover, it is not possible in such a room to transmit distinct sounds for both ears.

According to another process for simulating spatialisation effect, a series of loudspeakers oriented toward a listening point are distributed regularly in a circle, whereas each loudspeaker broadcasts a particular sound channel. This is therefore an extension of the stereophonic method over two channels. However, the spatialisation effect is effectively obtained in only one particular point of the room, so-called focal point. The listeners situated elsewhere than at this focal point can also hear the sounds, but they are subjected to acoustic illusions, which may be compared to optical illusions.

Still, a sound perceived may be reduced to a supposedly uniform acoustic pressure, at the eardrums. Thus, at the level of an ear, the only interesting variable is the acoustic pressure at the eardrum, itself depending on the acoustic pressure at the inlet of the auditive duct, on the listener's morphology. In an acoustic headset, the purpose is to reproduce this pressure, in order to reconstruct a sound.

However, for two different listeners, the acoustic pressure at the eardrum, and even at the inlet to the auditive duct resulting from the same sound source will be different. This will not prevent them, unless they have a hearing impediment, from locating the sound source correctly.

These differences between individuals and between the ears of the same person are due to morphological difference. Indeed, thee space between the listener's ears and the presence of an obstacle, i.e. the head, on the path of the acoustic wave, induce a phase-shift and a difference in intensity in an acoustic wave issued from the same sound source. Thus, the acoustic pressure at the eardrum is different between the right ear and the left ear, for the same sound source, relative to the position of said source with respect to the listener.

Diverse devices endeavour to spatialise a sound while taking into account these differences in perception between both ears. The aim is simply to broadcast the same sound, while taking into account physical phenomena causing a phase shift and a difference in intensity, in both ears. This is the binaural principle.

However, binaural techniques rely on a database gathering experimental measurements, corresponding to <<average>> morphologies. It is not possible to model the human auditive tract, notably the auricle, whose shape it too complex to take into account all the physical phenomena necessary to computing approach. Thus, the techniques used correspond to average ears and the measurements are performed on dummies. These techniques exhibit therefore the shortcoming of not being suitable to everybody.

The patent U.S. Pat. No. 6,038,330 also divulges an acoustic headset for sound spatialisation. The headset exhibits, for each headphone, loudspeakers arranged regularly on a cap-shaped surface.

Each of said loudspeakers is combined with a waveguide to direct and concentrate the sound transmitted onto the listener's auricle.

However, spectral representation of the sound transmitted by each of said loudspeakers is modified by said waveguides. Such a headset does not enable then to reconstruct sounds spatially following the Huygens-Fresnel principle.

BRIEF SUMMARY OF THE INVENTION

The aim of the present invention is to provide an acoustic headset for spatial reconstruction of a sound, which remedies the shortcomings aforementioned.

In particular, such a headset should enable transmission of distinct sounds for both ears, without depending on the individual characteristics of the auditive tract. In other words, such a headset should enable sound spatialisation for the great majority of listeners.

Another aim of the present invention is to provide a dynamic system, capable of taking into account the movements of the head in the reconstructed acoustic field using such a headset.

Another aim of the invention is to provide an acoustic headset with little space requirements, easy to use and enabling good mobility of the head, in particular to be adapted readily into a dynamic system.

An aim of the invention is also to provide headset enabling to reproduce a sound accurately, while avoiding any jerky feelings when moving a sound source, giving the impression of a continuous acoustic field.

Still, another aim of the invention is to provide a headset adaptable to any head.

Another aim of the invention is to provide a little expensive headset.

Still another aim of the invention is to provide a recording device which is compatible with such an acoustic headset.

Other aims and advantages of the invention will appear in the following description, only given by way of example and without being limited thereto.

The invention refers to a headset for spatial restitution of a sound fitted with two headphones, each headphone comprising a bracket defining at least partially a cap-shaped surface including globally the listener's ear, each headphone comprising at least five loudspeakers, arranged on said bracket and capable of reconstructing an acoustic field.

The invention also refers to a sound recording device intended for later spatial restitution, formed of a headset as defined above and wherein the loudspeakers are replaced with multidirectional or cardioid microphones, the recording cap-shaped surface corresponding to said recording device being confused with said cap-shaped surface (for acoustic transmission) of one said headset.

BRIEF DESCRIPTION OF THE SEVERAL VIEWS OF THE DRAWINGS

The invention will be better understood when reading the description in conjunction with the appended drawings.

DETAILED DESCRIPTION OF THE INVENTION

Figure 1:
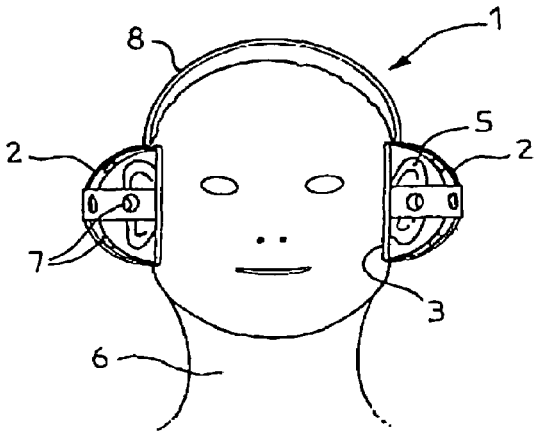
FIG. 1 represents a schematic view of the head of a person wearing an acoustic headset according to the invention.
Figure 2A:
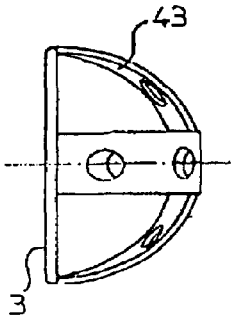
FIGS. 2*a*, 2*b*, 2*c* are perspective views of the left headphone of a headset according to the invention, respectively front, inside and rear views.
Figure 2B:
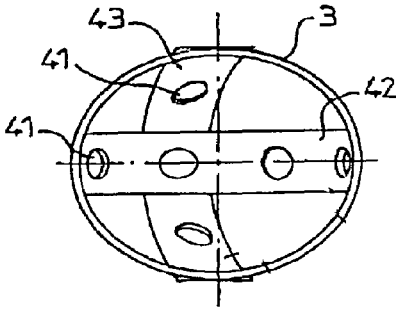
Figure 2C:
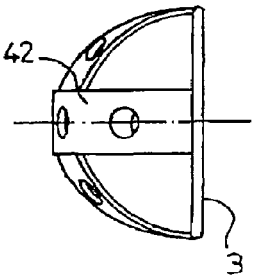
Figure 3A:
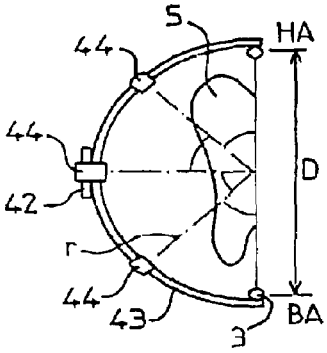
FIGS. 3*a* and 3*b* are sectional views of a headphone of a headset according to the invention, along a vertical plane and a horizontal plane, respectively.
Figure 3B:
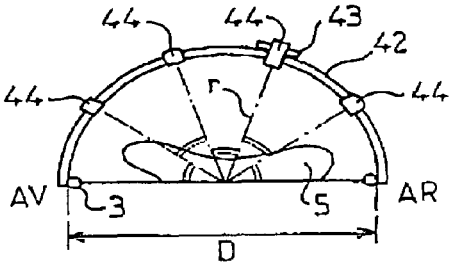

The invention is the result of the observation that there was not any easy simple device for sound spatialisation, requiring small computing power, and suitable for everybody. Indeed, the devices based on the binaural principle are specific to the listener (or the dummy) whereon the measurements have been taken while stereophonic halls only enable sound spatialisation in the focal point of the hall. In addition to this, the hall-based devices depend frequently on the geometry of the room and on the relative arrangement of the loudspeakers.

The inventors have developed the invention by modifying the viewpoint used to tackle the problem of sound spatialisation. Instead of trying to reproduce the acoustic pressure at the eardrum or at the inlet to the auditive duct. as had been the case until now, they have sought to reconstruct the acoustic wave as it may be measured at a given distance from the ear, before transformation by the auricle and the auditive duct. The inventors have hence decided to create a sound-transmitting surface surrounding the auricle of the ear. The fact that such surface surrounds the auricle is not inconspicuous. Indeed, this enables to break free from individual morphological characteristics of the auricle since the wave transmitted will be transformed by the auricle, as any other sound.

Using a headset enables moreover to dispense with the geometrical problems of a hall. This also enables to develop for example dynamic systems taking into account the movements of the head in space, in order to displace, virtually, the reconstructed sound environment relative to the movements of the head.

According to the Huygens-Fresnel principle, any point in space touched by an acoustic wave becomes a secondary source and re-transmits in turn a spherical wave. Thus, the contribution of a sound-transmitting surface as perceived by the eardrum is equivalent to the addition of all the spherical waves transmitted by the infinity of points of said sound-transmitting surface.

However, in practice, it is impossible to produce an infinity of sound sources. It has therefore been necessary to determine a finite number of sound sources which. broadcasting sounds simultaneously, would be equivalent to said sound-transmitting surface.

To do so, the information theory and more particularly the Shanon theorem, is used. According to this theorem, the sampling pulse of a sinewave signal should be at least twice as high as the pulse of said sinewave signal, if it is desirable to avoid a cohesion loss between the continuous sinewave signal and the sample. In other words, the sampling period should be twice as small as the period of the sinewave signal.

A sound signal may be broken down into a sum of sinewave signals. By space-time analogy, the sampling distance between two loudspeakers of the sound signal should be smaller than half the wavelength of this signal. If the limiting wavelength may be considered as the shortest wavelength of the signal, i.e. the limiting frequency is the highest frequency of the signal, the following is obtained: $\Delta l < \frac{1}{2}\lambda$, where l is the distance between two loudspeakers (or microphones) and $\lambda$ is the shortest wavelength of the signal.

Thus, the sampling (transmission or recording) keeps all the pieces of information of the sampled signal for the frequencies equal to or less than half the sampling frequency.

The range of audible frequencies is 20 Hz to 20 kHz, but the sound frequencies more often perceived are less than 5 kHz. A 10 kHz sampling frequency has therefore been selected.

As illustrated on the different Figures, a headset 1 is obtained, comprising two headphones 2, each headphone comprising at least five loudspeakers disposed on a bracket 3. Said bracket defines at least partially a cap-shaped surface, capable of surrounding the listener's ear 5 totally.

The <<cap-shaped>> expression means that the headphone surrounds the auricle totally, without creating any contact between the <<cap-shaped>> surface and the auricle. Advantageously, such surface is in the form of a hemisphere or a portion of hemisphere. It may also be ovoid possible polyhedral. The main thing is the fact that the cap-shaped surface surrounds the listener's ear, and forms a bracket skeleton for the loudspeakers.

On the different figures, said headphone exhibits a hemispherical capshaped surface.

Said headphone 2 may be open or closed. If it is open, said hemispherical surface is not materialised partially by the bracket 3. If it is closed, the bracket 3 materialises said hemispherical surface completely.

Advantageously, said at least five loudspeakers may be distributed crosswise, which enables to obtain a satisfactory acoustic transmitting surface.

Said bracket 3 is constituted of a ring in particular to which are attached two cambered bands, namely, a horizontal band 42 and a vertical band 43. Said cambered bands 42 and 43 form a cross. Moreover, they are drilled with orifices 41, capable of receiving said loudspeakers 44.

The orifices 41 are distributed regularly, so that the distance between two adjoining loudspeakers is smaller than or equal to 3 cm, for a maximum frequency of the sampled signal of 5 kHz. The diameter D of the bracket 3 is, in this example, 8 cm.

Each cambered band 42, 43 is fitted with an orifice 41 at the intersection point of both bands, as illustrated on the different Figures. For example, the horizontal band 42, comprises four orifices 41 spaced apart by an angle of 360 relative to one another; the vertical band 43 comprises three orifices 41 spaced apart by an angle of 45° relative to one another. Thus, the headphone 2 may accommodate six loudspeakers, one of them at the intersection of the bands 42, 43.

For example, the hemispherical surface has a radius r of 4 cm.

Obviously, a larger number of loudspeakers may be provided, disposed on, for example on the arms of a star and closer to one another, to obtain a maximum frequency of the sampled signal, then transmitted, greater than 5 kHz.

Figure 4:
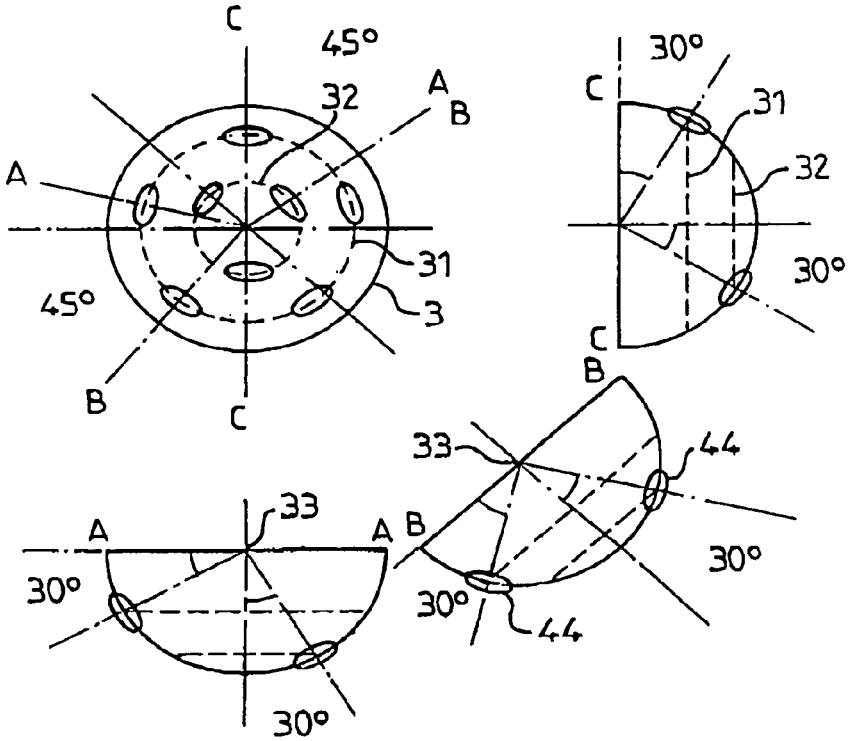
FIGS. 4 and 5 are two distribution variations of eight loudspeakers, or microphones. in a headphone illustrated as a top plan view and a sectional view.
Figure 5:
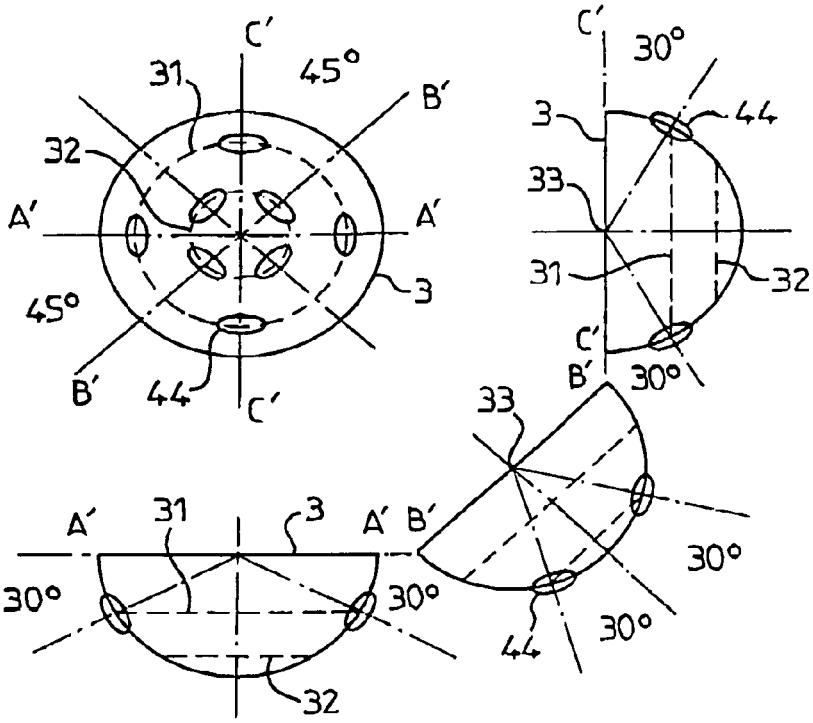

For example, as illustrated on FIGS. 4 and 5, the headphone may include eight loudspeakers 44. Top left on FIGS. 4 and 5 are represented a plan view of both these variations and, around the plan view, sectional views along the lines AA, BB, CC, A'A', B'B', C'C'. In these examples, the headphones are hemispherical.

Thus, as a plan view, the loudspeakers 44 are distributed regularly around two concentric circles, an external circle 31 of large radius and an internal circle 32 of radius smaller than that of the external circle 31.

In the variation illustrated on FIG. 4, the loudspeakers 44 are situated at the apex of a regular pentagon inscribed within the external circle 31 and of an equilateral triangle inscribed within the internal circle 32.

In the variation illustrated on FIG. 5, the loudspeakers A are situated at the apexes of two squares inscribed respectively within the internal circle 32 and the external circle 31, the diagonals of one of the squares being substantially parallel to the sides of the other square.

Advantageously, the external circle 31 and internal circle 32 are substantially parallel to the plane defined by the bracket 3 and are situated beneath an angle of 30° ($\pi/6$ rad) and of 60° ($\pi/3$ rad) with respect to the centre 33 of the hemisphere.

Figure 6:
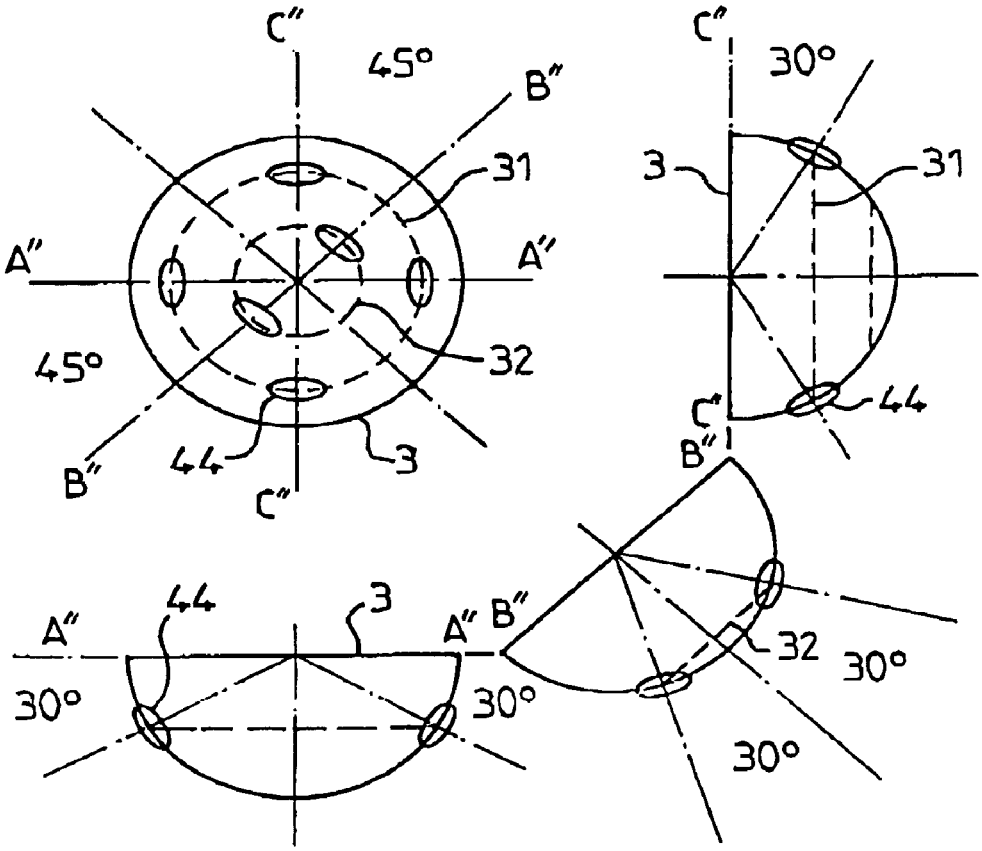
FIG. 6 is a distribution variation of six loudspeakers, or microphones, in a headphone, illustrated as a top plan view and a sectional view.

According to another variation, represented on FIG. 6, the headphone includes six loudspeakers 44, four distributed regularly at the apexes of a square inscribed within an external circle 31 and the two others distributed on a diagonal of said square, on an internal circle 32. Thus, said at least five loudspeakers are capable of reconstructing an acoustic field, perceived as continuous by the human ear, for acoustic frequencies smaller than a given maximum frequency, notably 5 kHz.

The expression <<perceived as continuous>> means that the displacement of a sound source transmitting a frequency signal equal to or less than 5 kHz, reconstructed by the acoustic headset, is perceived without any jerkiness or sudden bursts, but continuously. The listener has not the impression that the sound source goes without any transition from one point in space to another when the displacement should have been perceived as gradual.

Advantageously, a headset according to the invention comprises at least six loudspeakers per headphone.

According to a first variation of the invention, a headset 1 is fitted with open headphones, as illustrated on the different Figures. In this case, the bracket 3 is formed of an open armature, capable of receiving the loudspeakers. From an acoustic viewpoint, it means that the listener may hear a sound transmitted by the loudspeakers, without deformation, nor attenuation.

According to another variation, the headphones 2 are closed. In this case, the bracket is formed of a shell defining a hemispherical surface capable of receiving said loudspeakers.

Although not illustrated, electric connection means are provided between the loudspeakers 44 and, for example, for instance of an amplifier, a walkman. a sound card or any other similar electronic device. It may also be wireless transmission means, thereby avoiding the space requirements associated with electric wires.

Advantageously, said headset is used as a bracket for a microphone situated at the end of an arm, in front of the listener's mouth to enable the latter to speak, in particular interactively, with another person fitted for example with the same headset.

Said headphones 2 may exhibit diverse additional features. For example, the bracket 3, i.e. the listener's zone in contact with the listener's head, may be fitted with a foam ring, for enhanced comfort of the listener 6 when wearing the headset.

The elements of the bracket 3 are composed for example of aluminum or another lightweight metal or still plastic.

As illustrated, both headphones 2 of the headset 1 are connected by a band 8 running above the listener's head 6. It may be an adjustable band, made of diverse materials known to the man of the art.

Moreover, according to an advantageous feature, such an acoustic headset is equipped with a device tracking the displacements of the head or <<head-tracking>> device. Thus, the movements of the listener's head 6 may be detected and the signal broadcast by the loudspeakers of each headphone 2 can be modified in relation to such movements, in order to provide the listener 6 with a true impression of auditive displacement, in particular in a virtual space. This type of device is particularly useful when coupled to a three-dimensional vision headset.

The invention also relates to a recording device for later spatial reconstruction of a sound, formed of a headset as described above. Still, in such a recording device, the loudspeakers are replaced with multidirectional or cardioid microphones directed outside the headphones, i.e. facing the ears 5 of a potential listener 6.

For good compatibility between such a recording device and an acoustic headset 1 according to the invention, the recording cap-shaped surface corresponding to the recording device is confused with the acoustic transmitting cap-shaped surface of such and acoustic headset.

With such an acoustic headset and such a recording device, it is not necessary to worry with the transformations undergone by the sound wave, due to the acoustic headset, since the sounds are recorded and transmitted before transformations.

Such a headset may find its application in numerous domains, and in particular:

so-called <<virtual reality>> entertainments and games, which reconstruct a virtual audiovisual space, teleconference, for simulating a meeting or conference room and locating virtually the participants with respect to one another, other than through a simple monitor.

any other application when, for example. an acoustic space should be coupled with a visual space, whereas both have been reconstructed.

Naturally, other embodiments, obvious to the man of the art, could have been contemplated without departing from the scope of the invention, subject of the claims below.

We claim:

1. An apparatus for spatial restitution of a sound to a listener comprising:

a pair of headphones each having a bracket defining a protective cushion cupping the respective ear of the listener, said protective cushion generally defining a hemispherical surface, the headphone having at least five speakers positioned on said hemispherical surface, each of the speakers being non-directional; and an omnidirectional sound producing means connected to said pair of headphones, said sound producing means for reproducing a spatial quality of a sound by application of a Huygens Fresnel principle so that a sound surface corresponds to an addition of spherical curves emitted by the five speakers, two adjacent speakers of the five speakers being spaced by a distance less than a distance of one-half of a shortest wavelength corresponding to a given maximum frequency such that the sound is perceived by the listener as being continuous for frequencies less than said given maximum frequency, said given maximum frequency being a frequency that is audible to the ear of the listener.

2. The apparatus of claim 1, said at least five speakers comprising at least six speakers.

3. The apparatus of claim 1, said maximum frequency being 5 kHz, the two adjacent speakers being spaced by a distance of no more than 3 centimeters.

4. The apparatus of claim 1, the headphone being open, said bracket comprising a horizontal band and a vertical band.

5. The apparatus of claim 1, the headphone being closed, said bracket defining a shell having a cushion surface suitable for holding the speakers.

6. An apparatus for recording of a sound intended for ulterior spatial reproduction comprising:

a pair of headphones each having a bracket defining a protective cushion cupping the respective ear of a user, said protective cushion defining a generally hemispherical surface, the headphone having at least five omnidirectional or cardioid microphones oriented toward an exterior of the headphones, the microphones being positioned on said generally hemispherical surface; and an omnidirectional sound producing means connected to said pair of headphones, said sound producing means for reproducing a spatial quality of a sound by application of a Huygens Fresnal principle so that a sound surface corresponds to an addition of spherical waves received by the microphones, two adjacent microphones of the five microphones being spaced by a distance less than a distance of one-half of a short wavelength corresponding to a given maximum frequency, said given maximum frequency being a frequency that is humanly audible.

* * * * *